United States Patent [19]

Vogel

[11] 4,275,371

[45] Jun. 23, 1981

[54] ELECTROMAGNETIC ROTARY ACTUATOR

[75] Inventor: John D. Vogel, Brecksville, Ohio

[73] Assignee: The Singer Company, Stamford, Conn.

[21] Appl. No.: 61,164

[22] Filed: Jul. 26, 1979

[51] Int. Cl.[3] ..... H01F 7/18

[52] U.S. Cl. ..... 335/272; 310/49 R; 335/229

[58] Field of Search ..... 335/272, 229, 230; 318/696; 310/49

[56] References Cited

U.S. PATENT DOCUMENTS

| | | | |
|---|---|---|---|
| 2,446,579 | 8/1948 | Fritzinger | 335/230 |
| 3,206,160 | 9/1965 | Bennett | 335/272 |
| 3,434,082 | 3/1969 | Montagu | 335/229 |
| 3,596,119 | 7/1971 | Goldman | 310/49 |
| 3,599,069 | 8/1971 | Welch | 318/696 |
| 3,681,525 | 8/1972 | Wada et al. | 310/49 |
| 3,849,714 | 11/1974 | Goretzki et al. | 318/696 |

*Primary Examiner*—Harold Broome

*Attorney, Agent, or Firm*—David L. Davis; Robert E. Smith; Edward L. Bell

[57] ABSTRACT

An electromagnetic rotary actuator including three laminated pole pieces equiangularly spaced about an output shaft. Each of the pole pieces has a bobbin coil wound thereabout. The output shaft rotor is magnetized with four 90° poles. One of the stator coils is utilized as a reference coil and is energized with a DC current. The other two coils are each coupled to a respective drive transistor. The drive signals to the two drive transistors are complementary. The resultant magnetic field set up by the three stator coils interacts with the magnetic field from the output shaft rotor to move the output shaft to a selected angular position.

7 Claims, 6 Drawing Figures

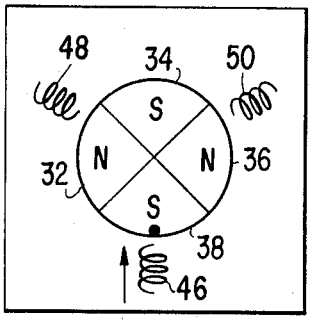
Fig.3A
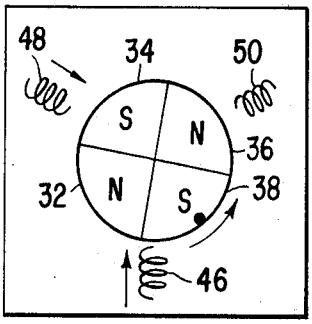
Fig.3B
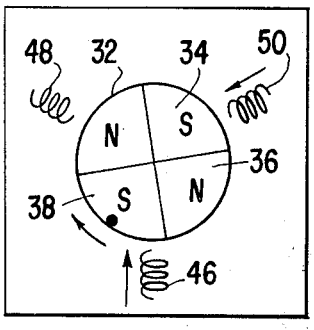
Fig.3C
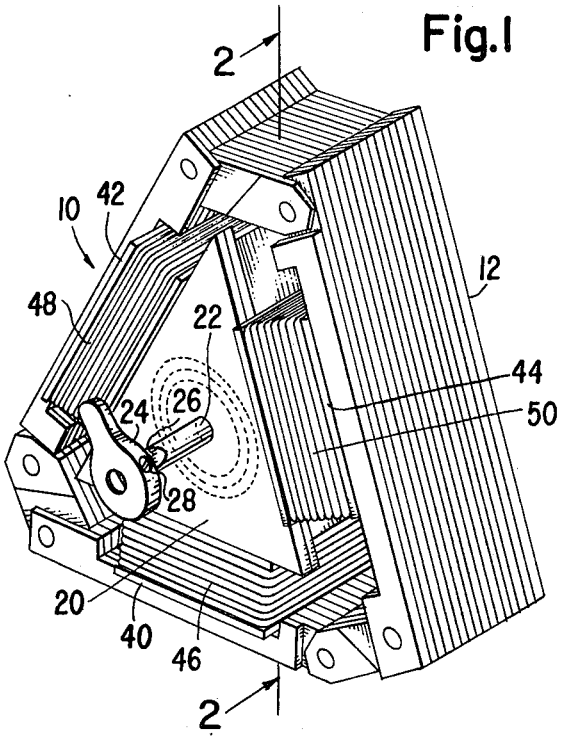
Fig.1
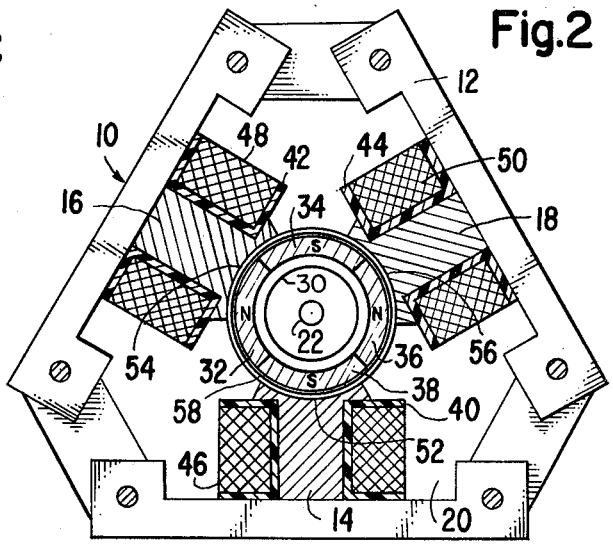
Fig.2
Fig.4
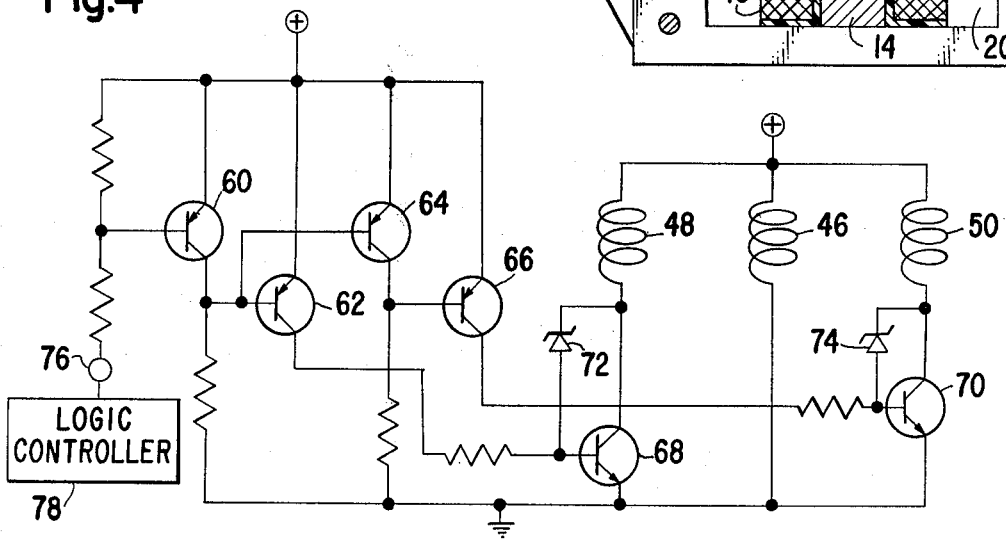

ELECTROMAGNETIC ROTARY ACTUATOR

BACKGROUND OF THE INVENTION

This invention relates to an electromagnetic rotary actuator and, more particularly, to such an actuator which is simple in construction and can be used in a non-feedback mode.

Electromagnetically operated positioning actuators of various types are known in the prior art. An illustrative actuator of simple construction and effective operation is the linear motor disclosed in U.S. Pat. No. 4,016,441. This linear motor comprises a frame having an internal central pole piece spaced intermediate two permanent magnets which are attached to the frame. The central pole piece provides a support for a moveable coil member integrally formed with connecting arms pivotally fastened to an actuator arm carried on a pivoted potentiometer shaft. Such an actuator requires feedback circuitry for accurate positioning and the circuitry adds additional expense to the cost of the actuator.

It is therefore an object of the present invention to provide an actuator which does not require feedback circuitry for the accurate positioning thereof.

An illustrative actuator which may be operated without feedback circuitry is the electromechanical disc adder mechanism described in U.S. Pat. No. 3,812,729. This disc adder mechanism comprises a plurality of discs which are arranged co-axially on a drive shaft including discs keyed to the drive shaft and freely journalled discs frictionally coupled to turn with the keyed discs. Axial cam segments on adjacent keyed and freely journalled discs may be selectively brought into engagement by electromagnetically influenced stop means for changing the angular orientation of the freely journalled discs relative to the keyed discs, thus selectively to regulate the total axial dimension of the stack of discs on the shaft which is the output of the adder mechanism. While not requiring feedback circuitry for accurate positioning, the construction of the disc adder mechanism is relatively complex.

It is therefore another object of the present invention to provide an actuator of simple construction.

SUMMARY OF THE INVENTION

The foregoing and additional objects are attained in accordance with the principles of this invention by providing an electromagnetic rotary actuator including a stator assembly having three pole pieces each with a coil wound thereabout. The coils may be selectively energized to establish a magnetic field through the respective pole piece. A rotor assembly is mounted for rotation about an axis inside the stator assembly, the rotor assembly having a permanently magnetized peripheral portion defining four regions of alternating magnetic polarity. Control means are further provided for selectively energizing the stator coils to generate a resultant magnetic field which interacts with the magnetic field from the magnetized peripheral portion of the rotor assembly to move the rotor assembly about the axis to a selected angular position.

In accordance with an aspect of this invention, one of the coils is a reference coil which is energized at a fixed level.

In accordance with a further aspect of this invention, the sum of the energizations supplied to the two remaining coils is a predetermined fixed level.

DESCRIPTION OF THE DRAWINGS

The foregoing will be more readily apparent upon reading the following description in conjunction with the drawings wherein:

FIG. 1 is a perspective view of an illustrative actuator constructed in accordance with the principles of this invention;

FIG. 2 is a cross-sectional view of the illustrative actuator taken along the lines 2—2 of FIG. 1;

FIGS. 3A, 3B and 3C schematically depict the operation of the illustrative actuator constructed in accordance with the principles of this invention; and FIG. 4 is a schematic circuit diagram of illustrative drive circuitry for an actuator constructed in accordance with the principles of this invention.

DETAILED DESCRIPTION

Referring now to the drawings, and in particular to FIGS. 1 and 2 thereof, depicted therein is an electromagnetic rotary positioning actuator, designated generally by the reference numeral 10, which includes a stator assembly comprising a generally triangular laminated frame 12 upon which are mounted three laminated pole pieces 14, 16 and 18. A pair of bearing plates 20 are attached to the three pole pieces to partially enclose the stator assembly.

The rotor assembly of the actuator 10 includes an output shaft 22 defining an axis of rotation and extending through suitable bearings in the bearing plates 20. To provide for mechanical output from the actuator 10, there is provided a crank arm 24 illustratively secured to a slabbed seat 26 of the output shaft 22 by means of a set screw 28. Between the two bearing plates 20, the output shaft 22 is part of the remainder of the rotor assembly which includes a steel sleeve 30. Bonded to the outer surface of the steel sleeve 30 is a permanently magnetized portion of the rotor assembly which includes four magnetic sectors 32, 34, 36 and 38. Illustratively, the sectors 32–38 are 5 grade oriented ceramic sectors magnetized in a radial direction. The directions of magnetization of the sectors 32–38 alternate so that the outer surface of the sector 32 is a north pole with respect to the inner surface of the sector 32; the outer surface of the sector 34 is a south pole with respect to the inner surface of the sector 34; the outer surface of the sector 36 is a north pole with respect to the inner surface of the sector 36; and the outer surface of the sector 38 is a south pole with respect to the inner surface of the sector 38. The letters N and S in FIG. 2, and also in FIGS. 3A–3C, represent the polarities of the outer surfaces of the sectors 32–38, as outlined above. The four magnetic sectors 32–38 are equal in size. Preferably, they each encompass an arc length of 90°.

As described above, the stator assembly of the actuator 10 includes a laminated frame 12 upon which are mounted three laminated pole pieces 14, 16 and 18. Supported on each of the pole pieces is a respective bobbin 40, 42 and 44 upon which is wound a respective coil 46, 48 and 50. The inner faces 52, 54 and 56, respectively, of the pole pieces 14, 16 and 18 are arcuately shaped and a copper sleeve 58 is supported by the faces 52, 54 and 56 of the pole pieces 14, 16 and 18. The copper sleeve 58 serves two functions. First, it provides a return path for the eddy currents of the stator assembly. Secondly, the annular space between the copper sleeve 58 and the rotor assembly is packed with grease to provide for mechanical damping of the rotor assembly motion.

Preferably, the three pole pieces 14, 16 and 18 are equiangularly spaced about, and equidistant from, the axis defined by the output shaft 22. More importantly, to operate in the manner to be described below so as to take advantage of relatively simple control and drive circuitry, the pole pieces 16 and 18 are equiangularly spaced on opposite sides of a line defined by the axis (the output shaft 22) and the pole piece 14, the coil 46 of which is hereinafter designated the reference coil.

The operation of the actuator 10 will now be explained with reference to FIGS. 3A–3C. The coil 46 is utilized as a reference coil and is energized by a constant DC voltage. The other two coils 48 and 50 are each coupled to a respective drive transistor. The drive signal to each of the coils 48 and 50 is in the form of a pulse width modulated square wave, the average value of the two waves corresponding to expected mechanical position. The three coils 46, 48 and 50 are all energized with the proper polarity so that the magnetic fields generated thereby preferably are all polarized in the same direction with respect to the output shaft 22. Illustratively, all their north poles are directed inwardly. The drive signals to the two drive transistors are complementary so that when a 10% average value signal is applied to the coil 48, a 90% average value signal is applied to the coil 50. FIG. 3A illustrates the position of the rotor assembly when the reference coil 46 is driven with a constant DC voltage and no drive is applied to the coils 48 and 50. This is also the position when a 50% average value signal is applied to the coils 48 and 50. FIG. 3B shows the rotor assembly position when a 100% average value signal is applied to the coil 48 and a 0% average value signal is applied to the coil 50. This position corresponds to a full left position of the output shaft 22. FIG. 3C illustrates the position of the rotor assembly when a 0% average value signal is applied to the coil 48 and a 100% average value signal is applied to the coil 50. This position corresponds to a full right position of the output shaft 22.

FIG. 4 is a schematic circuit diagram of illustrative drive circuitry for controlling the actuator 10. This circuit can be divided into two portions, a logic portion and a power portion. The logic portion includes the transistors 60, 62, 64 and 66 which function as an interface gain stage for the coil 48 and as an interface gain and signal inversion stage for the coil 50. The power portion of the circuit includes the transistor 68 which is the power drive transistor for the coil 48, and the transistor 70 which is the power drive transistor for the coil 50. The Zener diodes 72 and 74 limit the inductive spikes from the coils 48 and 50, respectively, to prevent damage to the drive transistors 68 and 70, respectively. The logic input to the circuit for controlling the positioning of the actuator 10 is applied to the terminal 76 from a logic controller 78 (not shown in detail) as a low level high impedance pulse width modulated square wave. The circuit of FIG. 4 supplies the same wave form with high power and low impedance to the coil 48 and a complementary signal to the coil 50. Additionally, a constant energization is supplied to the reference coil 46.

Accordingly, there has been disclosed an electromagnetic rotary actuator which is simple in construction and can be used in a non-feedback mode. It is understood that the above-described embodiment is merely illustrative of the application of the principles of this invention. Numerous other embodiments may be derived by those skilled in the art without departing from the spirit and scope of this invention, as defined by the appended claims.

I claim:

1. An electromagnetic rotary actuator comprising:

a stator assembly including three pole pieces, each of said pole pieces having a coil wound thereabout adapted for selective energization thereof to establish a magnetic field through the respective pole piece;

a rotor assembly mounted for rotation about an axis inside said stator assembly, said rotor assembly having a permanently magnetized peripheral portion defining four regions of alternating magnetic polarity; and control means for selectively energizing said stator coils to generate a resultant magnetic field which interacts with the magnetic field from said magnetized peripheral portion of said rotor assembly to move said rotor assembly about said axis to a selected angular position;

wherein one of said coils is a reference coil and the control means supplies said reference coil with a fixed energization and supplies a fixed total energization to the remaining two coils in a complementary manner.

2. The actuator of claim 1 wherein said control means is operative to establish magnetic fields through said pole pieces which are all polarized in the same direction with respect to said axis.

3. The actuator of claim 1 wherein said remaining two coils are equiangularly spaced on opposite sides of a line defined by the reference coil and the axis.

4. The actuator of claim 1 wherein said four regions of alternating magnetic polarity cover four equal angular sectors.

5. The actuator of claim 4 wherein each of said sectors encompasses an arc length of 90°.

6. The actuator of claim 1 wherein said stator assembly includes a hollow cylindrical electrically conductive sleeve member mounted on the inner faces of said pole pieces.

7. The actuator of claim 6 wherein said electrically conductive sleeve member defines an annular space surrounding said rotor assembly and further including a grease packing in said annular space.

* * * * *